US008998657B1

(12) United States Patent
Von Eckroth et al.

(10) Patent No.: US 8,998,657 B1
(45) Date of Patent: Apr. 7, 2015

(54) HIGH CURRENT FEMALE ELECTRICAL CONTACT ASSEMBLY

(75) Inventors: Kurt Von Eckroth, Wales, WI (US); Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 256 days.

(21) Appl. No.: 13/325,470

(22) Filed: Dec. 14, 2011

Related U.S. Application Data

(60) Provisional application No. 61/432,963, filed on Jan. 14, 2011.

(51) Int. Cl.
*H01R 11/22* (2006.01)
*H01R 13/11* (2006.01)
*H01R 13/193* (2006.01)

(52) U.S. Cl.
CPC ..... *H01R 13/113* (2013.01); *H01R 13/193* (2013.01); *H01R 13/114* (2013.01)

(58) Field of Classification Search
USPC ..... 439/884, 801, 810, 857, 727
See application file for complete search history.

(56) References Cited

U.S. PATENT DOCUMENTS

| | | | | | |
|---|---|---|---|---|---|
| 1,521,903 | A | * | 1/1925 | Mueller | 439/515 |
| 1,531,049 | A | * | 3/1925 | Thompson | 439/829 |
| 1,965,151 | A | * | 7/1934 | Mueller | 439/744 |
| 2,373,070 | A | * | 4/1945 | Wulstein | 439/829 |
| 3,605,066 | A | * | 9/1971 | Vierck et al. | 439/219 |
| 3,980,377 | A | * | 9/1976 | Oxley | 439/637 |
| 4,552,425 | A | | 11/1985 | Billman | |
| 4,892,492 | A | * | 1/1990 | Mueller | 439/828 |
| 4,964,807 | A | * | 10/1990 | Draus | 439/169 |
| 5,342,226 | A | | 8/1994 | Hayes et al. | |
| 5,427,552 | A | | 6/1995 | Zielinski et al. | |
| 5,433,629 | A | | 7/1995 | Yagi et al. | |
| 5,645,459 | A | * | 7/1997 | Fitting | 439/857 |
| 5,938,485 | A | | 8/1999 | Hotea et al. | |
| 6,000,974 | A | | 12/1999 | Hotea | |
| 6,056,604 | A | | 5/2000 | Roy et al. | |
| 6,089,929 | A | | 7/2000 | Sloey | |
| 6,171,155 | B1 | | 1/2001 | Miwa et al. | |
| 6,290,553 | B1 | | 9/2001 | Sato et al. | |
| 6,428,365 | B1 | | 8/2002 | Yamamoto | |
| 7,014,516 | B2 | | 3/2006 | Yang | |
| 7,150,660 | B2 | | 12/2006 | Allgood et al. | |
| 7,374,460 | B1 | | 5/2008 | Hariharesan et al. | |
| 7,530,855 | B2 | | 5/2009 | Hariharesan et al. | |
| 8,333,622 | B2 | * | 12/2012 | Blasko et al. | 439/852 |
| 2009/0186530 | A1 | | 7/2009 | Hariharesan et al. | |
| 2012/0115351 | A1 | * | 5/2012 | Bihrer et al. | 439/442 |

* cited by examiner

*Primary Examiner* — Neil Abrams
*Assistant Examiner* — Travis Chambers
(74) *Attorney, Agent, or Firm* — Boyle Frederickson, S.C.

(57) ABSTRACT

An electrical connection device has a first end and a second end configured to be electrically coupled to a first conductor and a second conductor. A pair of conductive elements are arranged between the first end and the second end and configured for engagement with the first and second conductors. The conductive elements include a respective flat segment and a bent segment. The bent segments define an opening in which one of the first and second conductors are configured to be received. The bent segments include a number of corners configured to engage opposing sides of the one of the first and second conductors at a number of discrete points along at least a portion of the length of the at least one first and second conductors.

20 Claims, 5 Drawing Sheets

HIGH CURRENT FEMALE ELECTRICAL CONTACT ASSEMBLY

CROSS-REFERENCE TO RELATED APPLICATIONS

This application claims priority to U.S. Provisional Patent Application No. 61/432,963 filed on Jan. 14, 2011 and entitled HIGH CURRENT FEMALE CONTACT ASSEMBLY, the entirety of which is hereby incorporated by explicit reference thereto.

BACKGROUND OF THE INVENTION

This invention relates to electrical contact assemblies, and more particularly, to high-current female contact assemblies.

Electrical contact assemblies are well-known in the art and are typically employed for coupling an electrical device, which may be part of or connected to an electrical circuit, with an electrical conductor. Known contact assemblies typically employ a male contact, which may be a flat blade of conductive material such as copper or brass. The male contact is inserted into a female receptacle that includes a corresponding pair of contacts, typically in the form of a pair of cantilevered leaves, arranged to define an opening, such that the male contact presses against the leaves of the female contact. The leaves of the female contact are formed as cantilevered beams, and thereby exert a contact force on the male contact. The deflection of the cantilevered beams produces an orthogonal force, i.e. normal to the face of the blade, to make an electrical contact between the female contact and the male contact. To achieve the necessary substantially high normal forces required for high-current contacts, the two leaves of the female contact must be very stiff. Typically, this is achieved by (i) using either thick and therefore expensive slabs of copper or brass, (ii) hardening the leaves, which thereby significantly reduces the useful life of the leaves, or (iii) alloying the material with a grain hardening substance such as phosphor or beryllium, which serves to disadvantageously reduce the resultant conductivity of the leaves. Moreover, cantilevered beams such as those known in the art contact the respective male blade at only a single, discrete location. As is generally understood, additional contact points are desirable in that the additional contact points serve to lower the contact resistance between the leaves and the blade.

Accordingly, a high-current female contact assembly that overcomes one or more of the foregoing disadvantages is desired.

SUMMARY OF THE INVENTION

The present invention is generally directed to a high-current, female contact assembly. The contact assembly includes a pair of leaves, straps, or conductive elements configured to engage a corresponding male contact, which may be in the form of a relatively flat blade or other such contact generally known in the art. At least one of the conductive elements of the contact assembly includes a bent segment, which may be in the form of a zigzag pattern having a number of undulations along the length of the bent segment or any other such bent shape in keeping with the present invention. In this manner, the conductive element of the contact assembly acts like a leaf spring and produces relatively high normal forces using materials that are thinner, softer, more conductive, and less expensive than that of the prior art. Moreover, the number of contact points between the conductive element and the male blade conductor is substantially increased, thereby decreasing the electrical contact resistance as is generally understood in the art.

In one construction, the contact assembly includes a first end adapted for electrical connection with a device via a first conductor. A second end is adapted for electrical connection with a second conductor. A first conductive element and a second conductive element extend between the first end and the second end, and at least one of the conductive elements includes a bent segment that defines at least a pair of contact points. In one form, both the first and the second conductive elements include bent segments, which define facing pairs of contact points that may be generally longitudinally aligned with one another. The first and second conductive elements may be configured to diverge and converge with respect to one another along their respective lengths. The first and second conductive elements define an opening for receiving the male contact so that the bent segments of each of the first and second conductive elements engage the male contact at a number of separate and discrete points along a length of the male contact.

The first and second conductive elements may include a flat segment opposite the bent segment configured for engaging a conductor, which may be electrically connected with the electrical device.

Various other features, objects and advantages of the present invention will be made apparent from the following detailed description and the drawings.

BRIEF DESCRIPTION OF THE DRAWINGS

The drawings illustrate one representative embodiment presently contemplated for carrying out the invention.

In the drawings.

DETAILED DESCRIPTION

Representative embodiments of the present invention will be described by the following, non-limiting examples which will serve to illustrate various features of the invention.

Figure 1:
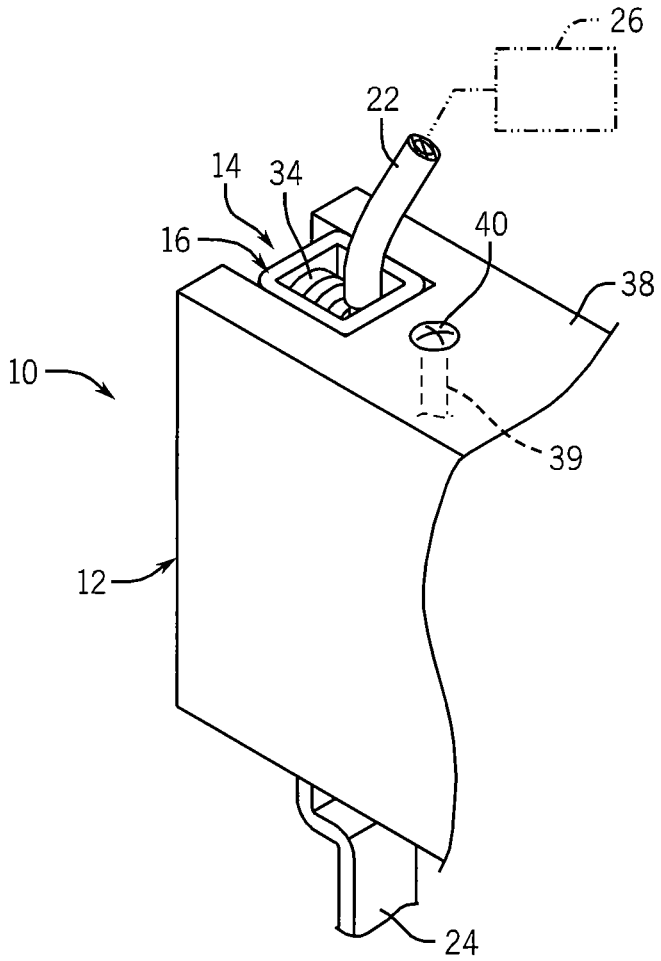
FIG. 1 is a partial isometric view of an electrical connection device in which the electrical contact assembly according to the present invention may be incorporated.
Figure 2:
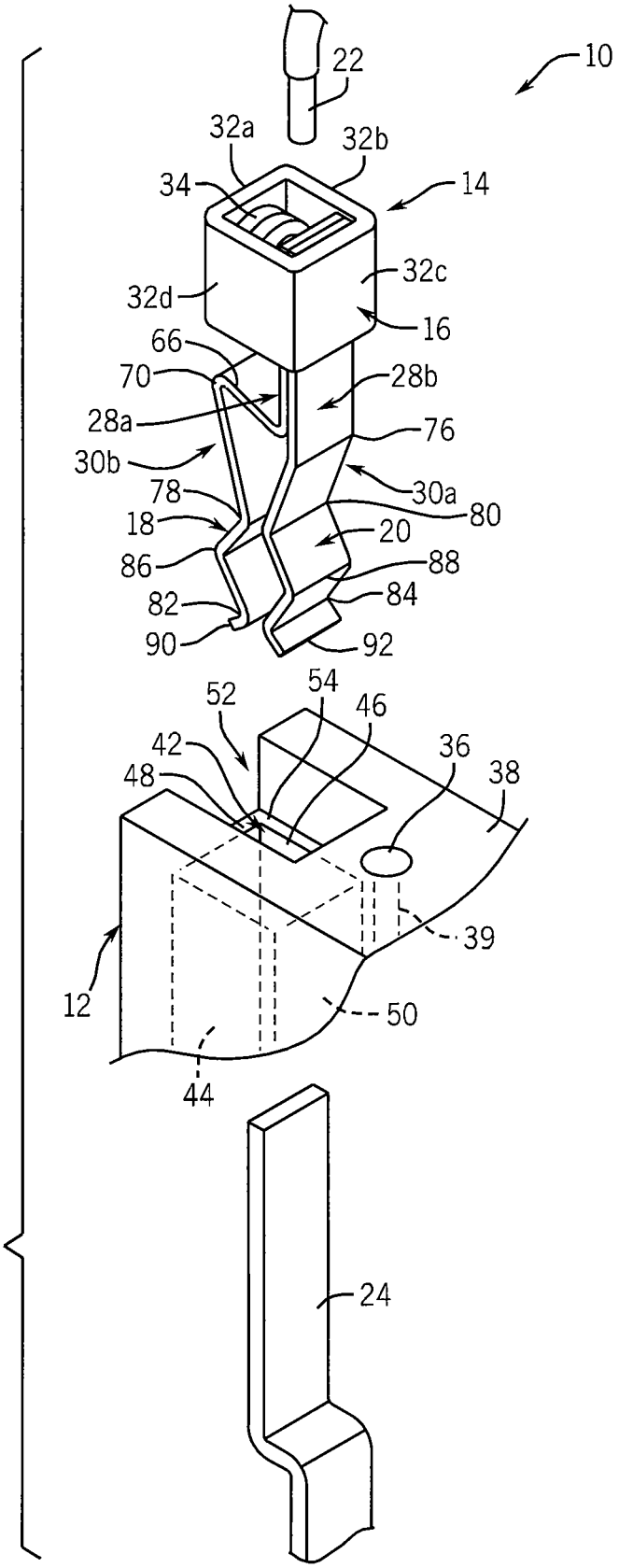
FIG. 2 is a partially exploded isometric view of the electrical connection device of FIG. 1, showing the electrical contact assembly according to the present invention.

With reference to the drawing figures in which like reference numerals designate like parts throughout the disclosure, a representative embodiment of the present invention is shown in FIGS. 1 and 2 as an electrical connection device 10 that is suitable for use in a variety of applications including, but not limited to, high-current applications of the kind generally known in the art. The electrical connection device 10 includes a housing 12 that holds an electrical contact assembly 14 according to the present invention.

The electrical contact assembly 14 includes a screw terminal 16 and a first conductive element 18 and a second conductive element 20, collectively, the conductive elements 18, 20. The conductive elements 18, 20 are configured to electrically couple the electrical connection device 10 with a first conductor 22 and a second conductor 24 as will be discussed in additional detail herein. The first conductor 22 is shown as a wire and may be connected to an electrical device 26, which is typically part of or connected to an electrical circuit. The second conductor 24 may be in the form of a high-current and/or high-amperage male, blade-type conductor or any other such conductor of the kind generally known in the art.

Figure 3:
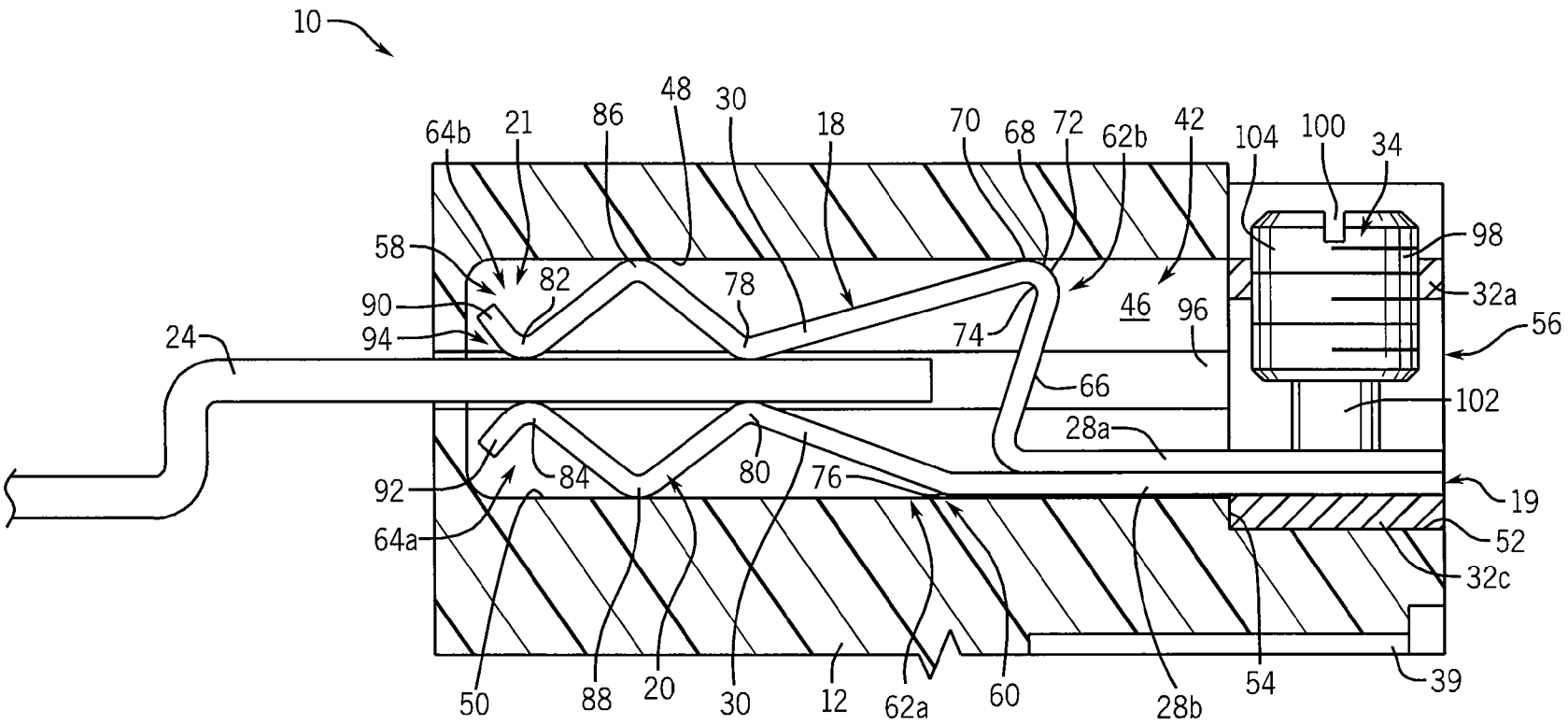
FIG. 3 is a longitudinal cross-section view of the electrical connection device of FIG. 1.

As shown in FIG. 3, the conductive elements 18, 20 have a first end 19 and a second end 21 opposite the first end 19. In one construction of the contact assembly 14, the first end 19 of the conductive elements 18, 20 is configured to electrically engage the first conductor 22 while the second end 21 of the conductive elements 18, 20 is configured to electrically engage the second conductor 24 as will be discussed in further detail herein. The conductive elements 18, 20 may be in the form of conductive leaves, straps, or any other suitable conductive elements.

Referring now to FIG. 2 in particular, the conductive elements 18, 20 include respective flat segments 28*a*, 28*b* and bent segments 30*a*, 30*b*. At least a portion of the flat segments 28*a*, 28*b* of the respective conductive elements 18, 20 may be configured to be received in the screw terminal 16 and extend outwardly from the screw terminal 16, while the bent segments 30*a*, 30*b* extend from the ends of the respective flat segments 28*a*, 28*b* away from the screw terminal 16 and are configured for engaging the second conductor 24 as will be discussed in further detail herein. In particular, the bent segments 30*a*, 30*b* are configured to engage the second conductor 24 at a number of discrete, spaced locations along a length of the second conductor 24 to decrease the electrical contact resistance. Understandably, the conductive elements 18, 20 may be constructed so that only one of the conductive elements has a bent segment 30 while the other may be entirely flat or otherwise configured. Moreover, any number of alternative arrangements are envisioned with respect to the conductive elements 18, 20 of the contact assembly 14 so long as the alternative arrangements are in keeping with the spirit of the present invention. In particular, in keeping with the present invention, the bent segments 30 are configured to engage the conductor 24 at multiple discrete locations along a length of the conductor 24 so as to decrease the contact resistance experienced therebetween.

Still referring to FIG. 2, the screw terminal 16 includes a generally hollow body, which may have a rectangular, square, oval, circular, polygonal, or other such cross-sectional shape. The body 32 includes a number of side walls 32*a*-32*d* that define the cross-sectional shape and define the hollow interior of the screw terminal 16. The hollow interior defined by the walls 32*a*-32*d* at least partially houses a fastener 34 such as a screw. As will be explained in further detail herein, the fastener 34 is configured to engage the flat segments 28 to secure the conductive elements 18, 20 within the hollow body of the screw terminal 16.

Referring again to FIGS. 1 and 2, the housing 12 of the electrical connection device 10 may be constructed from a polymeric or other insulating material. The housing 12 may have any desired configuration, and in the illustrated embodiment, the housing 12 includes a block-shaped body that includes a bore, passage, hole, or other such aperture 36 formed in an upper wall 38 and defining a passage 39 within the housing 12 that is configured to receive a fastener such as a bolt, pin, or other such piece of hardware 40, which functions as a set screw for mounting the housing 12 of the electrical connection device 10 within the overall electrical system to which the electrical connection device 10 is associated.

The housing 12 further includes a longitudinally extending passage 42 which is defined between interconnected walls 44, 46, 48, and 50, collectively walls 44-50. A pocket 52 is formed in the upper wall 38 of the housing 12 and intersects the passage 42. The pocket 52 is sized and configured to receive the screw terminal 16 of the contact assembly 14. The passage 42 is configured for receiving the contact assembly 14 so that the conductive elements 18, 20 are received entirely within the passage 42 and such that the screw terminal 16 is engaged with a shoulder 54 formed in the pocket 52. The shoulder 54 extends along the bottom of the pocket 52 around a periphery thereof and between the pocket 52 and the passage 42 to engage the screw terminal 16 to maintain the coupling between contact assembly 14 and the housing 12.

Referring now to FIGS. 3-7, the conductive elements 18, 20, as previously discussed, include respective flat segments 28*a*, 28*b* and bent segments 30*a*, 30*b*. The flat segments 28*a* extend from a first end 56 of the contact assembly 14 toward an opposing, second end 58. The flat segments 28*a*, 28*b* are stacked one on top of the other and are at least partially received within the screw terminal 16. The stacked flat segments 28*a*, 28*b* are arranged to abut against one of the walls of the screw terminal 16, such as wall 32*c*, so as to be at least partially secured within the screw terminal 16. The fastener 34 includes external threads that engage matching internal threads formed in wall 32*a*, and flat segment 28*a* of the first conductive element 18 is engaged by the end of the fastener 34 to secure the flat segments 28*a*, 28*b* within the screw terminal 16. In particular, when fastener 34 is advanced, the end of the fastener 34 engages the flat segment 28*a* of the first conductive element 18 and clamps flat segments 28*a*, 28*b* against the wall 32*c* of the body of the screw terminal 16. Thus, the conductive elements 18, 20 are securely held within the screw terminal 16. The flat segments 28*a*, 28*b* of the respective conductive elements 18, 20 terminate at respective first ends 62*a*, 62*b* of the bent segments 30*a*, 30*b*, which extend from the ends of the respective flat segments 28*a*, 28*b* toward the second end 58 of the conductive elements 18, 20 and terminate at respective second ends 64*a*, 64*b* of the respective bent segments 30*a*, 30*b*.

Figure 4:
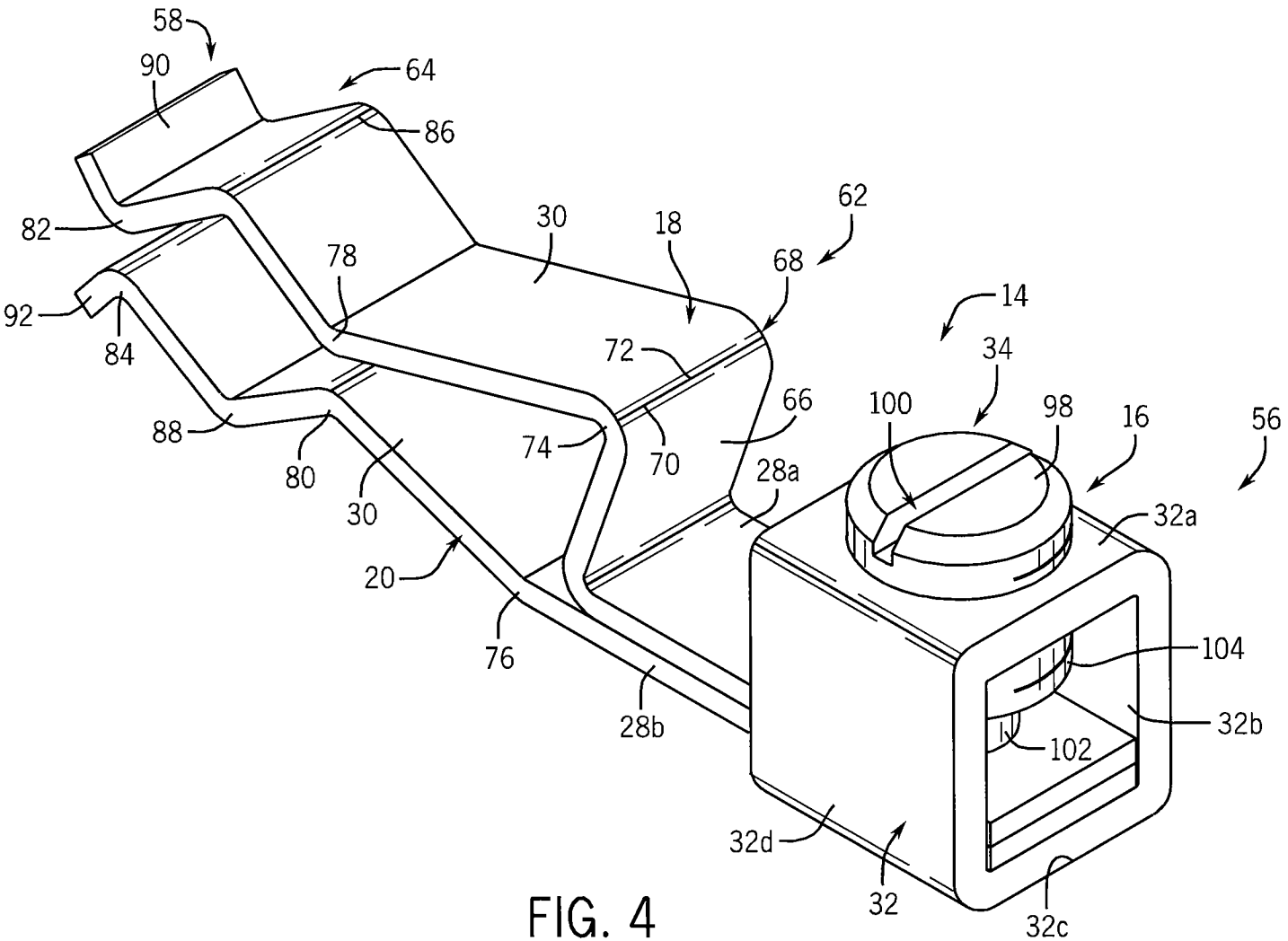
FIG. 4 is an isometric view of an electrical contact forming a part of the electrical contact assembly as shown in FIGS. 2 and 3.
Figure 5:
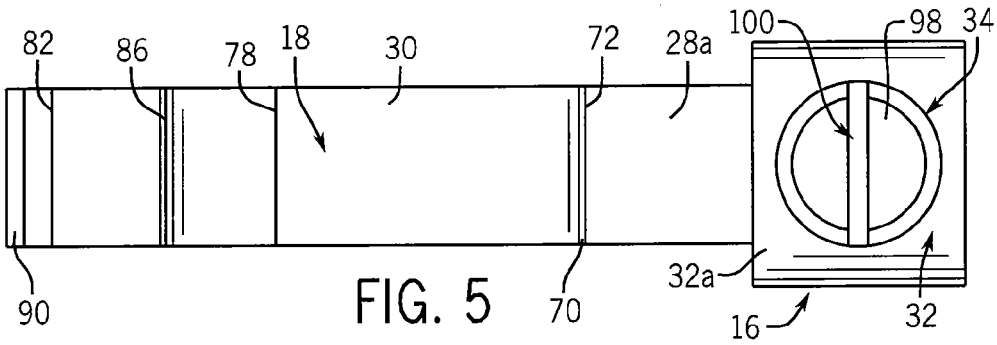
FIG. 5 is a top plan view of the electrical contact of FIG. 4.
Figure 6:
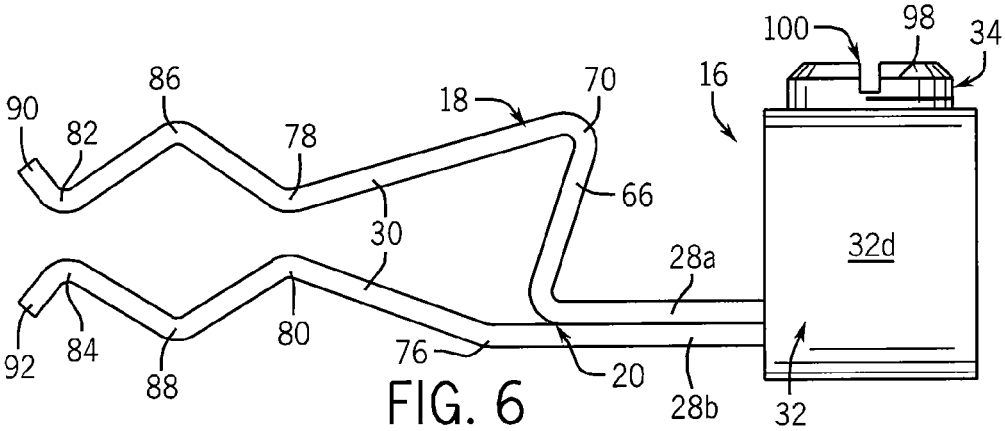
FIG. 6 is a side elevational view of the electrical contact of FIG. 4.
Figure 7:
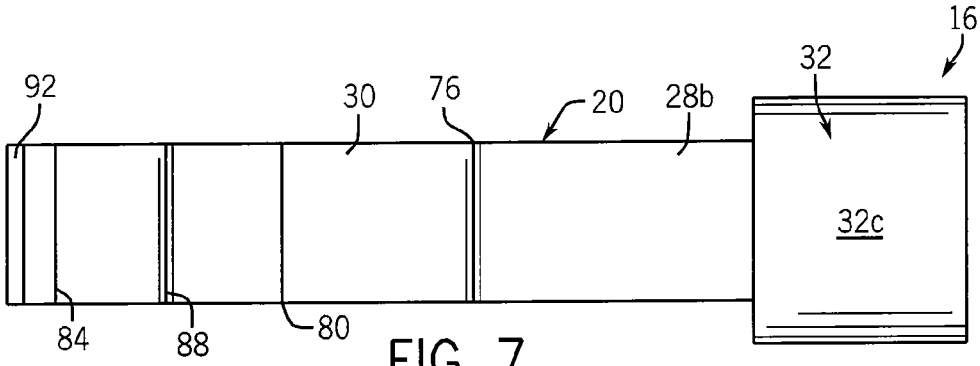
FIG. 7 is a bottom plan view of the electrical contact of FIG. 4.
Figure 8:
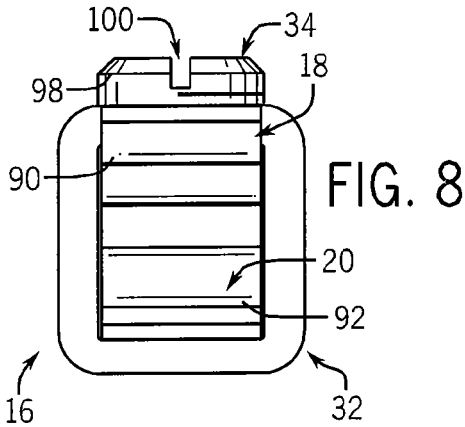
FIG. 8 is a front elevational view of the electrical contact of FIG. 4.
Figure 9:
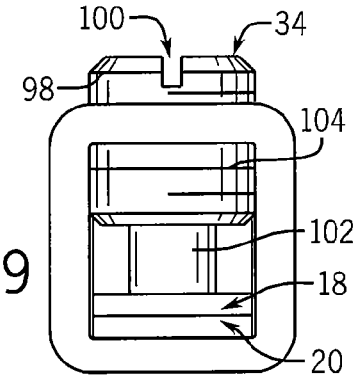
FIG. 9 is a rear elevational view of the electrical contact of FIG. 4.

Referring now to FIGS. 3, 4, and 6 in particular, at the termination point of the flat segments 28*a*, 28*b*, the respective conductive elements 18, 20 diverge away from one another. The first conductive element 18 may include a crossing portion 66 that bends or otherwise diverges sharply away from the second conductive element 20. The crossing portion 66 may diverge away from the second conductive element 20 at an angle that is equal to or greater than 90 degrees; understandably, the crossing portion 66 may diverge from the second conductive element 20 at any number of alternative angles. For example, the crossing portion 66 may bend away from the second conductive element 20 at an angle of greater than 90 degrees relative to the direction and plane along which an inner portion of the first conductive element 18 extends through the passage 42. The crossing portion 66 extends across the passage 42 and may be angled or otherwise directed toward the screw terminal 16. Of course, the crossing portion 66 may be angled or directed in a direction opposite the screw terminal 16 or may be orthogonally arranged relative a plane defined by the first conductive element 18 so as to directed away from or toward the screw terminal 16. The crossing portion 66 may include a terminal portion 68 positioned adjacent, in abutment with, or near the wall 48. The first conductive element 18 may include an elbow portion 70 or similar feature at the terminal portion 68. The elbow portion 70 may include an outer surface 72 that defines a corner that engages the wall 48 and an inner surface 74 opposite the outer surface 72, which may define an acute angle that is arranged to face obliquely downwardly across the passage 42 and generally in a direction away from the screw terminal 16. Understandably, the inner surface 74 may be configured in any number of alternative configurations.

Still referring to FIGS. 3, 4, and 6, the second conductive element 20 may include a base corner 76 that extends at an angle toward a longitudinal centerline of the passage 42. Along the length of the passage 42, the base corner 76 may be positioned at a distance further away from the screw terminal 16 than the elbow portion 70 of the first conductive element 18, or in an alternative arrangement, the elbow portion 70 may be positioned at the same distance or further from the screw terminal 16 than the base corner 76. From the elbow portion 70 and the base corner 76, the respective conductive elements 18, 20 extend along a longitudinal axis of the passage 42 and are arranged in a serpentine or zigzag pattern or similarly undulating pattern relative to one another, forming angled bends and corners therealong. In particular, the conductive elements 18, 20 may be configured so as to have portions that converge relative to one another and portions that diverge relative to one another. The conductive elements 18, 20 may include respective inner corners 78, 80 and 82, 84 that are configured to engage the second conductor 24 as will be discussed in additional detail herein. Understandably, the conductive elements 18, 20 may include one or more additional inner corners in keeping with the spirit and the goals of the present invention. The conductive elements 18, 20 may include corresponding respective outer corners 86, 88 that are disposed along the longitudinal axis defined by the passage 42 and positioned between the respective inner corners 78, 80 and 82, 84. One or more additional outer corners may be formed in the conductive elements 18, 20.

With continuing reference to FIGS. 3, 4, and 6, the bent segments 30 terminate respectively in end portions 90, 92, which may extend at an angle away from the inner corners 82, 84 to define an opening 94 between the conductive elements 18, 20 in which the second conductor 24 may be inserted for engagement with the conductive elements 18, 20.

Referring now to FIG. 3 in particular, the housing 12 may include a longitudinally extending groove 96 formed in at least an internal surface of the wall 46 in which the second conductor 24 may be received. A width of the groove 96 corresponds to a thickness of the second conductor 24. In this manner, the groove 96 is able to properly align with an opening at the end of the passage 42 and to maintain alignment of the second conductor 24 while it is being inserted into the electrical connection device 10. In addition, the wall 44, i.e. opposite the wall 46, may additionally include a groove (not shown) like the groove 96 of wall 46 and be correspondingly configured so as to guide the second conductor 24 from opposing sides while it is being engaged with the contact assembly 14 as may be readily appreciated. Understandably, the passage 42 may include an alternative construction such that it is entirely devoid of a groove or may include one or more alternative means for guiding and securing the second conductor 28 in place including any such suitable mechanical or similar such means capable of securing the second conductor 24 in keeping with the present invention.

While the conductive elements 18, 20 have been described as having complementarily shaped and configured zigzag patterns, it is readily understood that the patterns of the bent segments may be configured in any number of alternatively constructed manners. For example, the conductive elements need not have complementarily patterned bent segments but rather may include dissimilarly patterned and/or offset bent segments so long as in doing so the goals of the present invention are capable of being carried out as described herein, i.e. creating multiple electrical points of engagement along the length of the second conductor 24 with the first conductive element 18 and the second conductive element 20 of the contact assembly 14.

Now referring back to FIG. 3 in particular, the arrangement of the inner corners 78, 80 and 82, 84, outer corners 86, 88, and end portions 90, 92 relative to one another and relative to the housing 12 are configured to provide the desired movement restrictions and the corresponding performance characteristics of the bent segments 30 of the respective conductive elements 18, 20. For instance, selecting the sizes of the clearance between the respective portions of the conductive elements 18, 20 with one another and between one another and the housing 12 is done so as to provide the bending characteristics to the conductive elements 18, 20 and clamping force applications from the conductive elements 18, 20 to the second conductor 24. For example, the end portions 90, 92 are spaced from the walls 48, 50 while the second conductor 24 is held in the contact assembly 14. This configuration allows the end portions 90, 92 to flex relatively further away from the centerline of the longitudinal axis defined by the passage 42 as compared to other portions of the bent segments 30, which may facilitate initial insertion of the second conductor 24 into the contact assembly 14. In some embodiments, when the second conductor 24 is not inserted into the contact assembly 14, the outer corners 86, 88 are spaced from the walls 48, 50. As the second conductor 24 is inserted into the contact assembly 14, the second conductor 24 slides between the end portions 90, 92 and pushes the inner corners 82, 84 away from one another. This correspondingly flexes the conductive elements 18, 20 outwardly relative to one another through the remainder of the bent segments 30 thereof. The walls 48 and 50 limit the outward flexing of the conductive elements 18, 20 when the outer corners 86, 88 engage the inwardly facing surfaces of the walls 48, 50.

When the outer corners 86, 88 engage the walls 48, 50, (i) the conductive element 18 is supported by the wall 48 at the points of abutment between the wall 48, the outer corner 86, and the elbow portion 70 and (ii) the conductive element 20 is supported at the points of abutment between the wall 50, the outer corner 88, and the base corner 76. Further insertion of the second conductor 24 forces the conductive elements 18, 20 toward the walls 48, 50 in a direction that is generally orthogonal relative to the flat portion 28*a*, 28*b* of the respective conductive elements 18, 20, which thereby correspondingly provides reactive clamping forces on the conductive elements 18, 20 orthogonally against the conductor 24 as is readily understood. That is, as second conductor 24 is inserted between conductive elements 18, 20, conductive elements 18, 20 are forced outwardly against walls 48, 50, respectively. Such restraint against outward movement, combined with the zigzag or serpentine configuration of conductive elements 18, 20 enables the conductive elements 18, 20 to flatten slightly as second conductor 24 is inserted, which functions to positively force the inner corners 78, 82 and 80, 84 of respective conductive elements 18, 20 against second conductor 24.

In at least some of the embodiments of the invention, the conductive elements 18, 20 are substantially the same width as the second conductor 24. Therefore, when the second conductor 24 is fully inserted into the contact assembly 14, the conductive elements 18, 20 engage the second conductor 24 across substantially the entire width of the second conductor 24. Such full width engagement occurs at each of the discrete locations along the length of the second conductor 24 at which the inner corners 78, 80, 82, 84 engage the respective surfaces of the second conductor 24.

The particular extent of the movement restrictions of the conductive elements 18, 20 within the passage 42, along with the particular material composition, dimensions, and other characteristics of the conductive elements 18, 20 are selected to provide the desired amounts of clamping force at predetermined locations along the length of and orthogonally to the second conductor 24. For instance, in some embodiments, the desired amount of flexibility and resilience is provided with the conductive elements 18, 20 such that each has a thickness dimension that is less than the thickness dimension of the second conductor 24. Representatively, each of the conductive elements 18, 20 may be thicker than one half of the thickness of the second conductor 24. Notwithstanding the particular dimensions of the conductive elements 18, 20, it is fully appreciated that the configuration of the contact assembly 14 allows it to be constructed from, e.g. thinner, softer, more conductive and less expensive materials than has previously been possible while still enabling the conductive elements 18, 20 to withstand relatively high-amperage usage as is generally common in the art. It is further noted that although the exemplary drawings show four points of contact between the conductive elements 18, 20, the bent segments 30 may include more corners than are shown so as to achieve any number of additional points of contact therebetween along the length of the second conductor 24.

With reference to FIGS. 4-9, the elbow portion 70 and the crossing portion 66 are configured to facilitate insertion of the contact assembly 14 into the housing 12 and to prevent accidental or otherwise unwanted removal or withdrawal of the contact assembly 14 from the housing 12. The crossing portion 66 and the elbow portion 70 are configured such that the contact assembly 14 may be relatively easily inserted into the housing 12 by way of the passage 42 but may not be easily removed from the housing 12 via the passage 42. For example, during assembly of the electrical connection device 10, the second end 58 of the contact assembly 14 is leadingly inserted into the housing 12 past the pocket 52 and into the passage 42. Prior to insertion into the housing 12, the contact assembly 14 may define a distance between the outermost surface of the elbow portion 70 and the outermost surface of the second conductive element 20 that is greater than the distance between the walls 48 and 50 of the housing 12. Thus, when the contact assembly 14 is inserted into the housing 12, as the elbow portion 70 enters the passage 42, it engages the wall 48 and is deflected or otherwise directed toward the wall 50. Accordingly, the first conductive element 18 is compressed along the crossing portion 66. The compressed crossing portion 66 pushes transversely across the passage 42 and against the walls 48 and 50 thereby anchoring the contact assembly 14 within the passage 42. Conversely, when a force is applied to pull the contact assembly 14 from the passage 42, the crossing portion 66 is urged into an orthogonal position relative to the flat segment 28. In other words, the crossing portion 66 is straightened transversely across the passage 42 to thereby wedge the elbow portion 70 against the wall 48 with a correspondingly greater force than that being applied to remove the contact assembly 14, which resists the withdrawal of the contact assembly 14 from the housing 12.

Now referring to FIGS. 3-9, the fastener 34, as previously discussed, may be in the form of a screw or similar element having a head portion 98 including a slot 100 extending across a width of the head portion 98 for engagement by a tool such as a screw driver or the like for selective advancing and retracting the fastener 34 relative to the screw terminal 16 for engagement with the flat segment 28*a* of the conductive element 18. The fastener 34 may include a shank element 102 coupled with the head portion 98 that extends away from the head portion 98. The fastener 34 may be insertable through a hole or aperture (not shown) formed in the wall 32*a* of the body 32 of the screw terminal 16.

A portion of the head portion 98 may extend through the wall 32*a* to enable the operator to engage the slot 100 with a tool as previously discussed. Representatively, the head portion 98 may include a series of threads 104 or similar such feature configured to engage or otherwise cooperate with a correspondingly arranged portion of the wall 32*a*. For example, the head portion 98 may include a number of threads around a circumference thereof for rotatable engagement with a series of corresponding threads provided on the wall 32*a*. In this manner, the fastener 34 is selectively advanceable or retractable relative to the screw terminal 16 to either engage or disengage, respectively, the flat segment 28*a* of the first conductive element 18. Thus, the engagement between the fastener 34 and the flat segment 28*a* may be selectively adjusted by the operator of the electrical connection device 10 so that, as desired, the operator may tighten or loosen the engagement therebetween. In this manner, the contact assembly 14 of the present invention may be configured so as to accommodate any number of thicknesses of conductive elements 18, 20 as the fastener 34 may simply be adjusted to accommodate the varying thicknesses.

The present invention has been described in terms of a representative embodiment, and it is recognized that equivalents, alternatives, and modifications, aside from those expressly stated, are possible and within the scope of the appending claims.

What is claimed is:

1. A female electrical contact arrangement adapted for engagement with a male blade-type electrical conductor, comprising:

a housing having a passage configured to receive the male conductor, wherein at least a portion of the housing is defined by spaced apart first and second sidewalls formed of a non deformable material that define the passage, wherein the first and second sidewalls are in a constant fixed position relative to each other, and wherein the passage extends along a longitudinal axis;

a first conductive element located adjacent the first sidewall;

a second conductive element located adjacent the second sidewall;

a screw terminal selectively engageable with a first end of the first conductive element and the second conductive element, wherein the screw terminal is configured for engagement with a portion of an electrical connection device;

wherein the first conductive element and second conductive element define an open conductor insertion space therebetween; wherein at least the first conductive element has an undulating configuration that defines at least a pair of longitudinally spaced conductor engagement areas and a pair of sidewall engagement areas; and wherein, when the male conductor is inserted into the passage between the first and second conductive elements, the pair of sidewall engagement areas of the first conductive element engage the first sidewall at a pair of discrete longitudinally spaced locations along the length of the first sidewall and the pair of conductor engagement areas of the first conductive element electrically engage the male conductor at a pair of discrete longitudinally spaced locations along the length of the male conductor.

2. The female electrical contact arrangement of claim 1, wherein the first conductive element and the second conductive element each has an undulating configuration.

3. The female electrical contact arrangement of claim 1, wherein at least one of the first conductive element and the second conductive element includes an uncurved segment.

4. The female electrical contact arrangement of claim 1, wherein the first conductive element and the second conductive element include respective uncurved segments, and wherein the uncurved segments of the first conductive element and the second conductive element are configured to overlap at least a portion of the respective other one of the uncurved segments.

5. The female electrical contact arrangement of claim 1, wherein the screw terminal defines a hollow cross-sectional shape configured to receive a portion of a fastener, wherein the fastener is configured to engage a portion of at least one of the first conductive element and the second conductive element for securing the first conductive element and the second conductive element within the hollow cross-sectional shape defined by the screw terminal.

6. The female electrical contact arrangement of claim 1, wherein the first conductive element and the second conductive element have undulating segments, and wherein the undulating segments are configured to alternatingly diverge and converge relative to one another.

7. The female electrical contact arrangement of claim 1, wherein the undulating configuration defines an outwardly flared opening configured for receiving the male conductor between the first conductive element and the second conductive element.

8. The female electrical contact arrangement of claim 1, wherein the first and second conductive elements each have an undulating configuration, and wherein the undulating configuration of the first conductive element comprises:

a crossing portion that diverges from the second conductive element at a first angle;

at least two inner corners configured to selectively engage the conductor at the two or more discrete locations along a length of the conductor;

at least one outer corner disposed between the at least two inner corners;

an end portion that diverges away from the second conductive element at a second angle;

wherein the second conductive element comprises:

a base corner that diverges from the first conductive element at a third angle;

at least two inner corners configured to selectively engage the conductor at the two or more discrete locations along a length of the conductor;

at least one outer corner disposed between the at least two inner corners;

an end portion that diverges away from the first conductive element at a fourth angle; and wherein the end portions of the first and second conductive elements define an opening within which the conductor may be introduced into engagement with the first and second conductive elements.

9. The female electrical contact arrangement of claim 1, wherein the first conductive element and the second conductive element each engage the first and second sidewalls at at least two discrete locations located along a length of the passage when the male conductor is inserted into the passage.

10. A female electrical connection device comprising:

a housing having a passage configured to receive a male conductor, wherein the housing includes spaced apart first and second sidewalls formed of a non-deformable material such that the sidewalls are in a constant fixed position relative to each other, and wherein the passage extends along a longitudinal axis and is defined at least in part by the first and second sidewalls;

an electrical contact assembly comprising a first conductive element located adjacent the first sidewall and a second conductive element located adjacent the second sidewall and a screw terminal within which at least a portion of the first and second conductive elements are received, wherein the first conductive element and second conductive element define an open conductor insertion space therebetween that is in communication with the passage wherein at least a portion of the first conductive element has an undulating configuration that defines at least a pair of longitudinally spaced conductor engagement areas and a pair of longitudinally spaced sidewall engagement areas, and wherein, when the male conductor is inserted into the passage between the first and second conductive elements, the pair of sidewall engagement areas of the first conductive element engage the first sidewall at a pair of discrete longitudinally spaced location along the length of the sidewall and the pair of conductor engagement areas of the first conductive element electrically engage the male conductor at a pair of discrete longitudinally spaced locations along the length of the male conductor.

11. The female electrical connection device of claim 10, wherein the housing defines a pocket and comprises a shoulder configured to engage a portion of the electrical contact assembly to thereby secure the electrical contact assembly relative to the housing.

12. The female electrical connection device of claim 10, wherein the first conductive element and the second conductive element comprise an uncurved segment and an undulating segment and wherein the respective undulating segments are configured to engage the male conductor at the at least two discrete locations along a length thereof.

13. The female electrical connection device of claim 10, wherein the screw terminal comprises a selectively advanceable fastener having a portion configured to selectively engage at least a portion of at least one of the first and the second conductive elements to thereby secure the electrical contact assembly to the screw terminal.

14. The female electrical connection device of claim 10, wherein the first and second conductive elements each comprise an undulating segment, wherein the undulating segment of the first conductive element comprises, a crossing portion that diverges from the second conductive element at a first angle;

at least two inner corners configured to engage the male conductor;

at least one outer corner disposed between the at least two inner corners; and an end portion that diverges from the male conductor at a second angle;

wherein the second conductive element comprises, a base corner;

at least two inner corners configured to engage the male conductor and generally aligned with the at least two inner corners of the first conductive element;

at least one outer corner disposed between the at least two inner corners and generally aligned with the at least one outer corner of the first conductive element; and an end portion that diverges away from the male conductor, wherein the end portion of the first conductive element and the second conductive element define an opening within which the male conductor may be introduced into engagement with the first and second conductive elements.

15. A method of constructing a female electrical contact assembly comprising the steps of:

providing a housing having a passage configured to receive a male conductor, wherein at least a portion of the housing includes sidewalls formed of a non-deformable material such that the sidewalls are in a constant fixed position relative to each other, and wherein the passage extends along a longitudinal axis and is defined at least in part by spaced apart first and second sidewalls;

arranging a first conductive element adjacent the first sidewall and a second conductive element adjacent the second sidewall so as to selectively receive the male conductor therebetween; and coupling a screw terminal to an end of the first and second conductive element, wherein the screw terminal is configured to secure the first and second conductive elements to one another and to electrically couple the first and second conductive elements to a second conductor, wherein the first conductive element and second conductive element define an open conductor insertion space therebetween, wherein the first conductive element and the second conductive element each have a portion having an undulating configuration that defines at least a pair of longitudinally spaced conductor engagement areas and a pair of longitudinally spaced sidewall engagement areas, and wherein when the male conductor is inserted into the passage between the first and second conductive elements, the pair of sidewall engagement areas of the first conductive element engage the first sidewall at a pair of discrete longitudinally spaced locations along the length of the first sidewall and the sidewall engagement areas of the second conductive element engage the second sidewall at a pair of discrete longitudinally spaced locations along the length of the second sidewall and the pair of conductor engagement areas of the first conductive element and the second conductive element electrically engage the male conductor at a pair of discrete longitudinally spaced locations along the length of the male conductor.

16. The method of claim 15, further comprising the step of overlapping at least a portion of the first and second conductive elements with one another, and wherein the overlapping portion comprises an uncurved segment.

17. A female electrical contact arrangement adapted for engagement with a male blade-type electrical conductor, comprising:

a housing having a passage configured to receive the male conductor, wherein at least a portion of the housing is defined by spaced apart first and second sidewalls formed of a non-deformable material that define the passage, wherein the first and second sidewalk are in a constant fixed position relative to each other, and wherein the passage extends along a longitudinal axis;

a first conductive element located adjacent the first sidewall;

a second conductive element located adjacent the second sidewall; and a screw terminal selectively engageable with a first end of the first conductive element and the second conductive element, wherein the screw, terminal is configured for engagement with a portion of an electrical connection device, wherein the first conductive element and second conductive element define an open conductor insertion space therebetween; wherein at least the first conductive element has an undulating configuration that defines at least a pair of longitudinally spaced conductor engagement areas and a sidewall engagement area therebetween; and wherein, when the male conductor is inserted into the passage between the first and second conductive elements, the sidewall engagement arca of the first conductive element engages the first sidewall and the pair of conductor engagement areas of the first conductive element electrically engage the male conductor at a pair of discrete longitudinally spaced locations along the length of the male conductor.

18. The female electrical contact arrangement of claim 17, wherein the screw terminal defines a hollow cross-sectional shape configured to receive a portion of a fastener, wherein the fastener is configured to engage a portion of at least one of the first conductive element and the second conductive element for securing the first conductive element and the second conductive element within the hollow cross-sectional shape defined by the screw terminal.

19. The female electrical connection device of claim 17, wherein the screw terminal comprises a selectively advanceable fastener having a portion configured to selectively engage at least a portion of at least one of the first and the second conductive elements to thereby secure the electrical contact assembly to the screw terminal.

20. A method of constructing a female electrical contact assembly comprising the steps of:

providing a housing having a passage configured to receive a male conductor, wherein at least a portion of the housing includes sidewalls formed of a non-deformable material such that the sidewalls are in a constant fixed position relative to each other, and wherein the passage extends along a longitudinal axis and is defined at least in part by spaced apart first and second sidewalls;

arranging a first conductive element adjacent the first sidewall and a second conductive element adjacent the second sidewall so as to selectively receive the male conductor therebetween, wherein the first conductive element and second conductive element define an open conductor insertion space therebetween, wherein at least the first conductive element has a portion having an undulating configuration that defines at least a pair of longitudinally spaced conductor engagement areas and a sidewall engagement area therebetween, and wherein when the male conductor is inserted into the passage between the first and second conductive elements, the sidewall engagement area of the first conductive element engages the first sidewall and the pair of conductor engagement areas of the first conductive element electrically engage the male conductor at a pair of discrete longitudinally spaced locations along the length of the male conductor; and coupling a screw terminal to an end of the first and second conductive element, wherein the screw terminal is configured to secure the first and second conductive elements to one another and to electrically couple the first and second conductive elements to a second conductor.

* * * * *